US005620039A

United States Patent [19]

Delgado et al.

[11] Patent Number: 5,620,039

[45] Date of Patent: Apr. 15, 1997

[54] APPARATUS FOR PROVIDING A SLIDINGLY-SEPARABLE CONNECTION BETWEEN A MOVABLE BARRIER AND A MEANS FOR GUIDING THE BARRIER

[75] Inventors: Joe M. Delgado, Hartford; Walenty Kalempa, Slinger, both of Wis.

[73] Assignee: Rytec Corporation, Jackson, Wis.

[21] Appl. No.: 387,411

[22] Filed: Feb. 10, 1995

[51] Int. Cl.[6] ..... E06B 9/17

[52] U.S. Cl. ..... 160/265; 160/271

[58] Field of Search ..... 160/265, 273.1, 160/271, 270, 272, 278, 268.1, 23.1, 133

[56] References Cited

U.S. PATENT DOCUMENTS

| | | |
|---|---|---|
| 1,033,224 | 7/1912 | Andlauer . |
| 1,922,389 | 8/1933 | Nye . |
| 3,797,553 | 3/1974 | Elliott . |
| 3,878,879 | 4/1975 | Manns . |
| 3,981,343 | 9/1976 | DeVito . |
| 4,036,517 | 7/1977 | Talmadge . |
| 4,478,268 | 10/1984 | Palmer . |
| 4,676,293 | 6/1987 | Hanssen . |
| 4,690,195 | 9/1987 | Taylor . |
| 4,711,505 | 12/1987 | Lakso . |
| 4,800,946 | 1/1989 | Rosenoy . |
| 5,025,847 | 6/1991 | Mueller . |
| 5,048,588 | 9/1991 | Weishar et al. . |
| 5,056,579 | 10/1991 | Krafutler . |
| 5,139,074 | 8/1992 | Warner . |
| 5,139,075 | 8/1992 | Desrochers . |
| 5,141,043 | 8/1992 | Kraeutler . |
| 5,141,044 | 8/1992 | Hying et al. . |
| 5,222,541 | 6/1993 | Hornberger ..... 160/265 |
| 5,271,448 | 12/1993 | Delgado . |
| 5,299,617 | 4/1994 | Hying et al. . |

FOREIGN PATENT DOCUMENTS

| | | |
|---|---|---|
| 966811 | 10/1950 | France . |
| 352251 | 3/1961 | Sweden . |
| 29295 | of 1914 | United Kingdom . |
| 563606 | 8/1944 | United Kingdom . |

*Primary Examiner*—David M. Purol
*Attorney, Agent, or Firm*—Wallenstein & Wagner, Ltd.

[57] ABSTRACT

Apparatus for separably connecting a movable barrier to a means for guiding the barrier is disclosed. The connection separates upon a transbarrier impact in excess of a predetermined magnitude. To this end a lateral connecting member (22) extends between the barrier (12) and the guide means (18) and includes opposed first and second ends (22*a* and 22*b*). The first end (22*a*) being attached to the guide 18 and the second end 22*b* has opposed upper and lower surfaces 46, 48 arcuate portions 46*a*, 46*b*, 48*a* and 48*b*. A receptacle 24 is attached to the movable barrier 12 and is adapted to receive the second end 22*b* of the lateral connecting member 22. The receptacle 24 has facing upper and lower inner surfaces 42, 44. The lateral connecting member 22 and the receptacle 24 are cooperatively dimensioned so that, over a predetermined range of rotation of the receptacle 24, a greatest distance between any point on the upper outer surface 46 and any point on the lower outer surface 48 of the second end of the lateral connecting member 22*b* is no greater than a smallest distance between any point on the upper inner surface 44 and any point on the lower inner surface 42 of the receptacle 24.

24 Claims, 5 Drawing Sheets

APPARATUS FOR PROVIDING A SLIDINGLY-SEPARABLE CONNECTION BETWEEN A MOVABLE BARRIER AND A MEANS FOR GUIDING THE BARRIER

TECHNICAL FIELD

The present invention relates generally to movable barriers, such as flexible roll-up curtain doors or panel doors, which can be opened by accumulating the door overhead, and more particularly to a slidingly-separable connection between a movable barrier and its associated jambs or guides.

BACKGROUND OF THE INVENTION

Recently, those in the art of manufacturing movable barriers, such as flexible roll doors, have provided separable connections between the barrier and the means for guiding the barrier within the confines of the opening. The separable connection is provided to minimize damage in the event of an impact on the barrier, such as by a service vehicle.

The first and most comprehensive development in this area to date is disclosed in U.S. Pat. No. 5,025,847, issued to Mueller, and assigned to the Assignee of the present invention. Mueller discloses a roll door having a two-part guide follower. This guide follower is designed to separate to allow the door and one part of the guide follower to be released from the other part of the guide follower in response to an excessive transverse force.

The separable connections of Mueller and subsequently others operate on the principle that the connections are slidingly separable. Particularly, a first member attached to a guide mechanism in the door jambs extends toward the barrier and a portion thereof is cooperatively fitted into a receptacle-type structure in the barrier. Most frequently, this receptacle is formed in a rigid leading edge of the barrier, commonly referred to as a bottom bar of the barrier. In the event of an impact, in excess of a predetermined magnitude, the guide follower separates and the barrier is allowed to move transversely of the opening without damage to the door or to the guide followers. Such systems have found widespread use and have been found to significantly reduce the damage to overhead doors caused by unintended impacts, as, for example, with a moving forklift.

However, it has been discovered that, during some impacts, the bottom bar of the movable barrier becomes rotated. The bottom bar may also be forced into a translational motion in a direction which, while generally transverse to the plane of the barrier, is not 90° with respect to the plane of the barrier. On these occasions, upper and lower surfaces within the receptacle can jamb or bind on upper and lower surfaces of the first member. This can cause a substantial increase in the amount of force required for separation of the two components. In extreme cases, the resistance will so far exceed the desired predetermined separation force as to cause damage to the movable barrier and possibly to the guide means and associated apparatus.

While operating on the same broad principles as disclosed in Mueller, the present invention is directed to solving the above problems and to provide further improvements over the basic structures known in the prior art.

SUMMARY OF THE INVENTION

The present invention provides an apparatus for connecting a movable barrier to a means for guiding the barrier during operation to selectively block an opening. The connection separates upon a transbarrier impact in excess of a predetermined magnitude.

According to one aspect of the invention, the apparatus includes a lateral connecting member extending toward a barrier and having opposed first and second ends. The first end is attached to the means for guiding the barrier and the second end is adapted to be received by a receptacle. The receptacle is attached to the movable barrier and is adapted to receive the second end of the lateral connecting member. The lateral connecting member and the receptacle are cooperatively dimensioned so that, over a range of relative rotation between the receptacle and the connection member that one predetermines as being acceptable, the lateral connecting member and the receptacle are slidingly separable.

According to another aspect of the invention, the second end of the lateral connecting member has generally opposed upper and lower outer surfaces. The receptacle has generally facing upper and lower inner surfaces. The lateral connecting member and the receptacle are cooperatively dimensioned so that, over a predetermined range of relative rotation, a smallest vertical distance between any point on the upper inner surface and any point on the lower inner surface of the receptacle is no less than the height between the upper outer surface and the lower outer surface of the second end of the lateral connecting member.

According to another aspect of the invention, the lateral connecting member and the receptacle are cooperatively dimensioned so that, over a predetermined range of relative rotation, the greatest distance between any point on the upper outer surface and any point on the lower outer surface of the second end of the lateral connecting member is no greater than the smallest distance between any point on the upper inner surface and any point on the lower inner surface of the receptacle.

According to another aspect of the invention, at least one of the upper and lower surfaces of the second end of the lateral connecting member includes arcuate or tapered portions connecting the upper or lower outer surface to side surfaces. The arcuate, or optionally tapered, surfaces are considered to form a part of the respective upper and lower outer surfaces. Again, the lateral connecting member and the receptacle are cooperatively dimensioned so that, over a predetermined range of relative rotation, a greatest distance between any point on the upper outer surface and any point on the lower outer surface of the second end of the lateral connecting member is no greater than the smallest distance between any point on the upper inner surface and any point on the lower inner surface of the receptacle. Optionally, the upper and lower inner surfaces of the receptacle terminate in arcuate or tapered portions directed away from an interior of the receptacle.

According to a preferred embodiment, the second end of the lateral connecting member is an elongate vertical rectangle defining a shoe.

The above-summarized features of the invention may be also be employed with apparatus wherein the second end of the lateral connecting member generally defines other than a rectangle. For example, the second end of the lateral connecting member can generally define a square cross-section or a horizontally-extending circular or oval-shaped cylinder with flat upper and lower outer surfaces.

All of the above configurations provide enhanced operability of the separable connection during impacts on the barrier where either the receptacle or the lateral connecting member become rotated.

Other advantages and aspects of the present invention will become apparent upon reading the following description of the drawings and detailed description of the invention.

DETAILED DESCRIPTION

Figure 2:
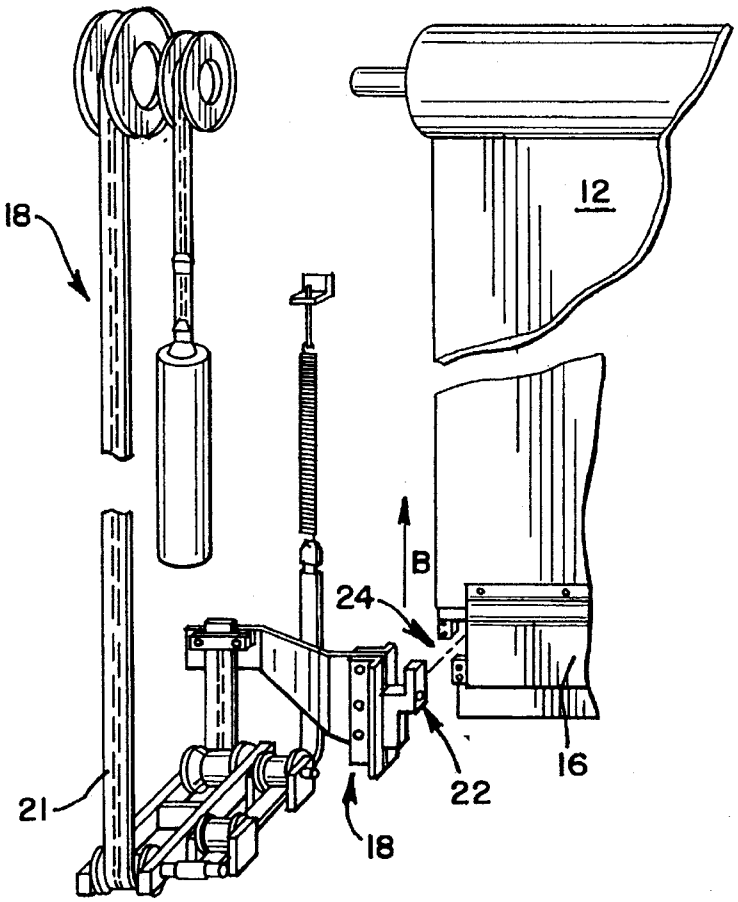
FIG. 2 is a partial exploded perspective view of the door 10 of FIG. 1.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1:
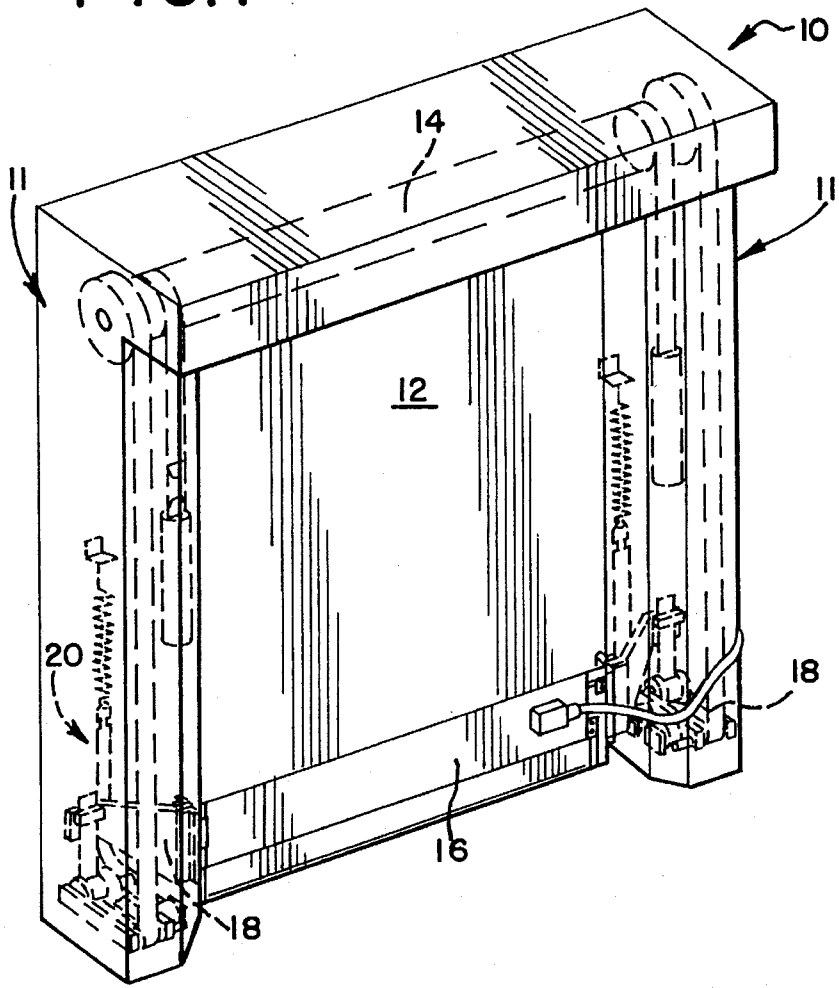
FIG. 1 is a perspective view of a flexible roll-up door 10 employing a preferred embodiment of the invention, counterbalance and tension mechanism 20 are shown in ghost.

FIG. 1 discloses a roll-up door 10, which includes opposed side jambs 11, a flexible curtain 12, a drum 14, a rigid leading edge for the curtain 12 in the form of a bottom bar 16, a guide 18 at each side of the curtain 12 for guiding it during opening and closing and for stabilizing the door in its closed position, and a tension mechanism 20 in each jamb 11 for providing a constant tension on the guides 18 for added control and stiffness of the flexible curtain 12. During operation, the flexible curtain 12 is rolled up and down on drum 14, while the guides 18 maintain the curtain 12 in a uniform path. Because of the symmetrical nature of certain aspects of door 10, such as jambs 11, tension mechanisms 20, guides 18, lateral connecting members 22 and receptacles 24, i.e., being on both sides of curtain 12, these and other symmetrical structures will be hereafter discussed in the singular for simplicity.

As best disclosed in FIGS. 2, 3, 4 and 6, the bottom bar 16 of the flexible curtain 12 is connected to the guide 18 through a laterally-extending lateral connecting member 22, which cooperatively is received in receptacle 24 of the bottom bar 16. The tension mechanism 20 is such as disclosed in U.S. Pat. No. 4,997,022, the disclosure of which will be understood by those in the art.

Figure 4:
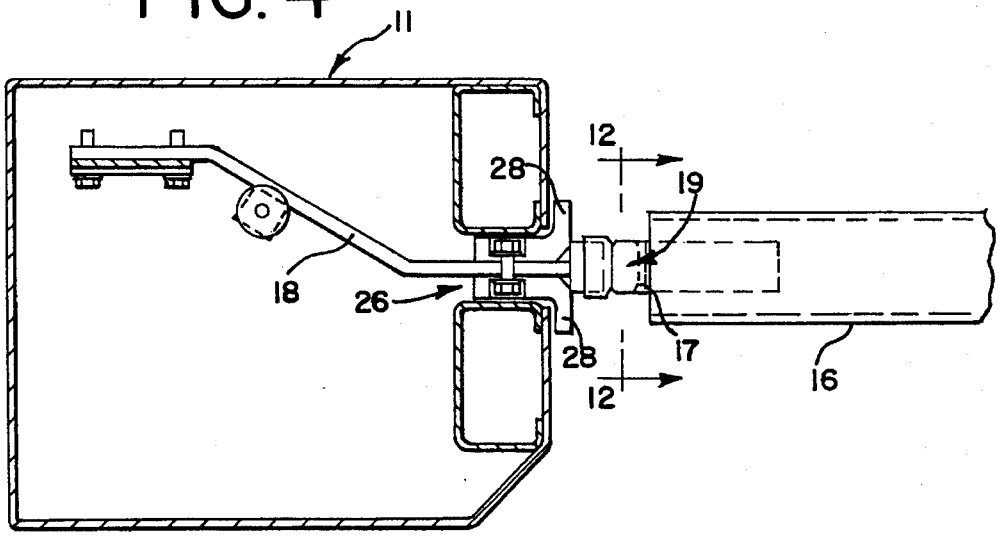
FIG. 4 is a cross-sectional view taken along line 4—4 of FIG. 3.

The guide 18 follows a vertical slot 26 in the jambs 11, as best disclosed in FIG. 4. Spacers 28 are provided on both sides of guide 18 within the slot 26. The spacers 28 are manufactured from a low-friction material to reduce wear and to assist in smooth and uniform opening and closing of the flexible curtain 12. A rubber foot 30 on a lower portion of guide 18 is provided to limit the extent to which the door can be closed against a threshold. The rubber foot 30 also reduces impact from the door as it closes rapidly. Rubber foot 32 on an upper portion of the guide 18 provides a similar function for when the door is rolled to its uppermost position, providing a shock-absorbing positive stop.

Figure 3:
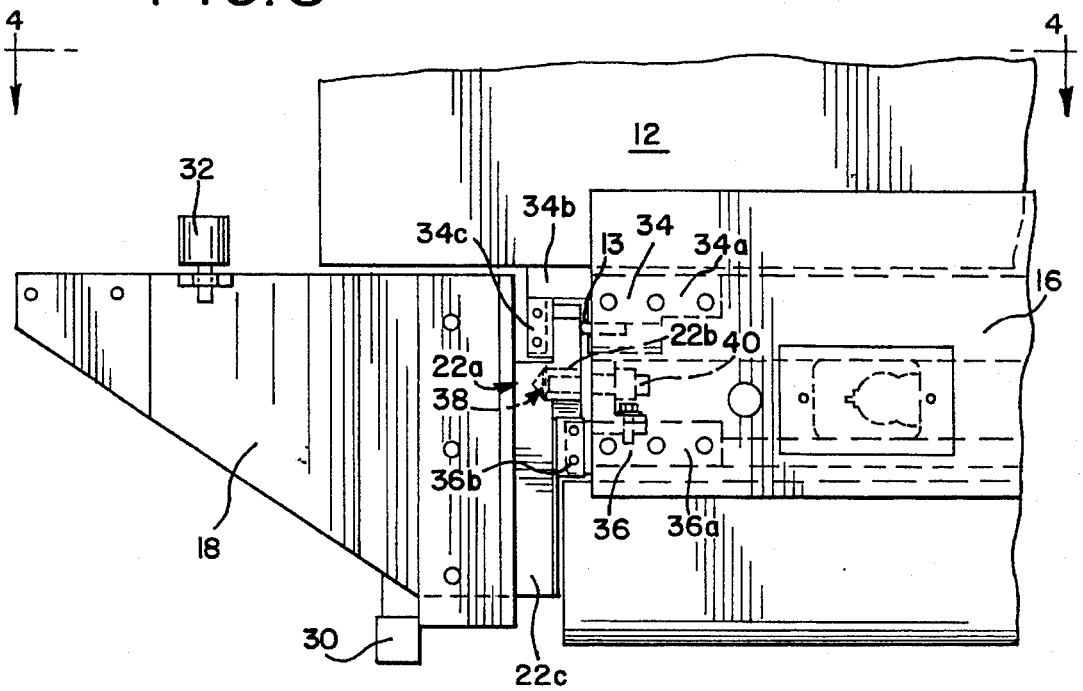
FIG. 3 is a front elevational view of a portion of the door 10 of FIG. 1 showing a preferred embodiment of the separable connection according to the present invention.
Figure 6:
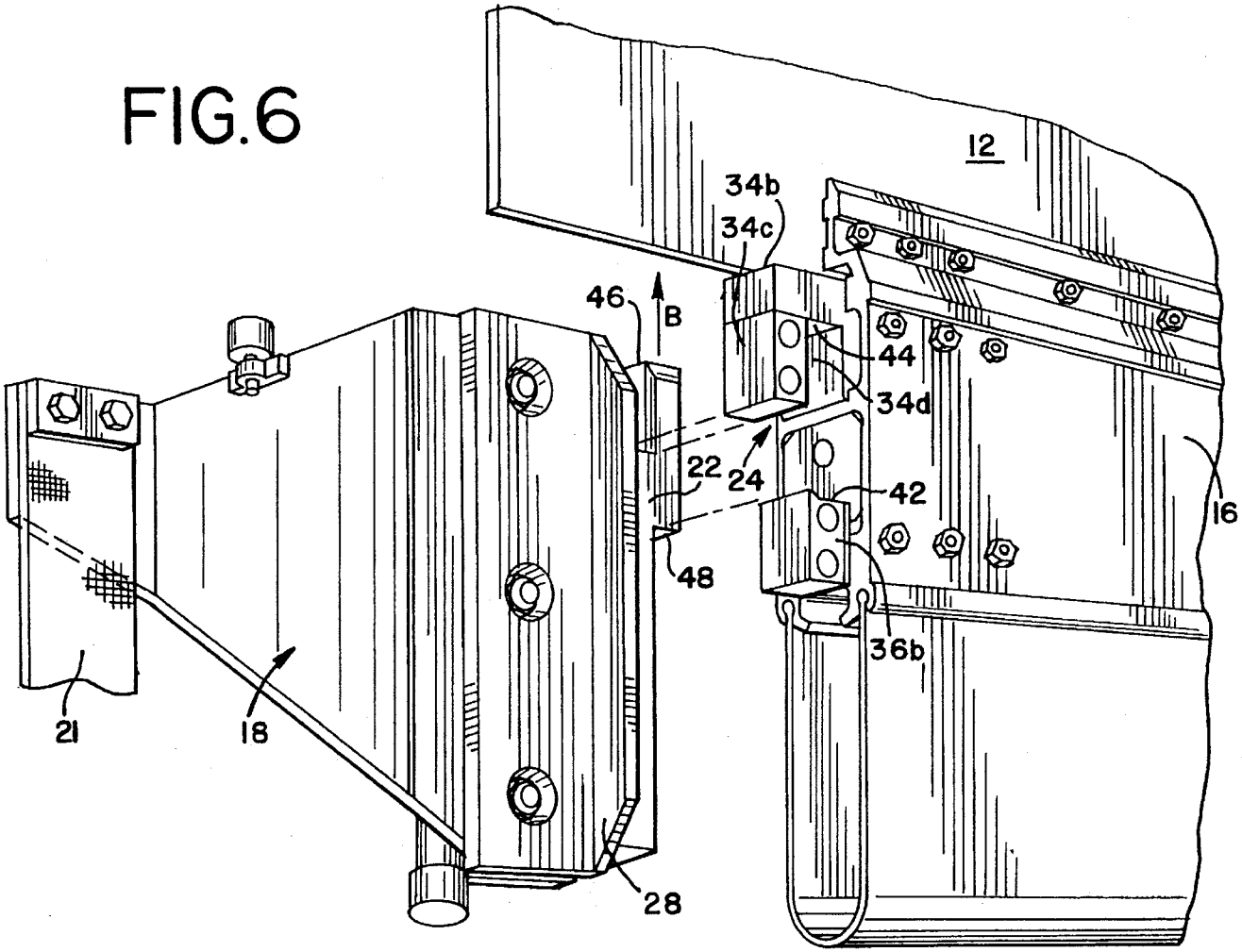
FIG. 6 is a perspective view in partial of the door 10 of FIG. 1.

FIG. 6 best discloses how the lateral connecting member 22 and the receptacle 24 appear after a separation due to a force of magnitude in excess of a predetermined amount. FIG. 3 shows the inner connection of the lateral connecting member 22 and the receptacle 24.

FIGS. 3 and 6 disclose that receptacle 24, in this embodiment, is comprised of an upper block 34 and a lower block 36. A portion 34*a* of upper block 34 is recessed into the bottom bar 16, while a portion 34*b* of block 34 extends beyond an end of the bottom bar 16. Lower block 36 has a portion 36*a*, which is recessed into the bottom bar 16, and a portion 36*b* extends beyond the end of the bottom bar. A portion 34*c* of upper block 34 depends from a terminal end of portion 34*b*, creating a space 34*d* between portion 34*c* and the portion 34*a* of upper block 34. The extending portion 36*b* of lower block 36 and the extending portions 34*b* and 34*c* of upper block 34 define receptacle 24. Receptacle 24 receives the lateral connecting member 22, in a manner which will be described in more detail below. Presently, suffice it to say that lateral connecting member 22 has a first end 22*a* connected to guide 18, and a second end, which extends into the receptacle 24 and defines a vertical elongate rectangular portion or shoe 22*b*. An extended base portion 22*c* of lateral connecting member 22 depends from first end 22*a*. In this preferred embodiment, portions 22*a*, 22*b* and 22*c* are formed as an integral piece of steel. The depending portion 22*c* is preferably welded to the guide member 18. As disclosed in FIG. 4, a slot 19 in side face 17 of shoe 22*b* cooperates with a spring-loaded ball 13 loaded on an inside surface of the end of bottom bar 16 within the receptacle 24. As disclosed in FIG. 3, this slot 19 and ball 13 are employed to help align and hold the shoe 22*b* in the receptacle during reassembly. Tension system 20 pulls the shoe 22*b* into depending portion 34*c* during normal operation, which stabilizes the interconnection by lateral and frictional forces.

A permanent magnet 38 is cooperatively and magnetically coupled with reed-type magnetic sensor 40 to detect when the shoe 22*b* is separated from receptacle 24, so as to stop an electric motor (not shown) from continuing to open or close the flexible curtain 12 upon impact.

Figure 5:
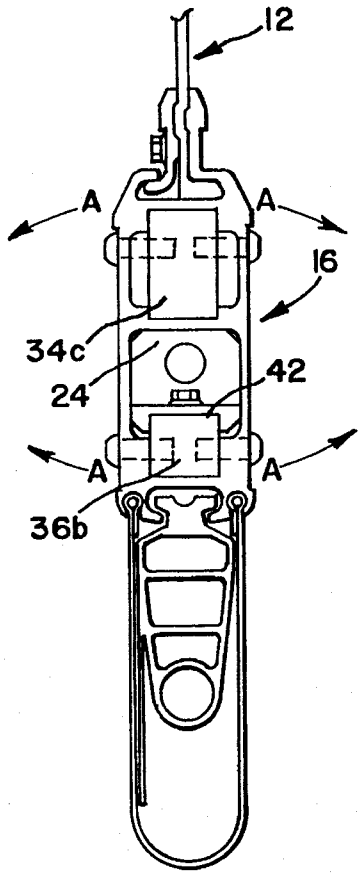
FIG. 5 is an end view of a bottom bar with an attached receptacle 24, according to the present invention.
Figure 12:
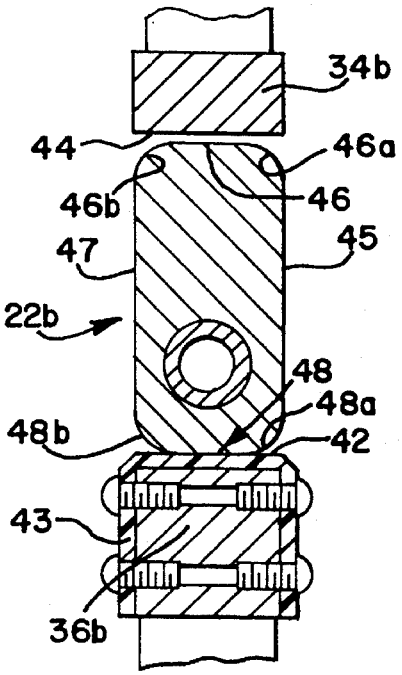

As best disclosed in FIGS. 6 and 12, portion 36*b* of lower block 36 has an upper-facing surface 42. Portion 34*b* of upper block 34 has a downward-facing surface 44. Shoe 22*b* has an upward-facing upper surface 46 and an opposed downward-facing lower outer surface 48. The surfaces 42, 44, 46 and 48 are those of most significant interest during impacts on the bottom bar 16, which cause the bottom bar to rotate in a manner, such as shown by arrows A in FIG. 5.

To best disclose the principles of the present invention, reference will now be made to the schematic representations of a receptacle and a shoe-type second end of a lateral connecting member. FIGS. 7–11 schematically disclose various situations and configurations with respect to sliding separation between a receptacle and a shoe, such as shoe 22*b*, during impact and rotation.

Figure 7:
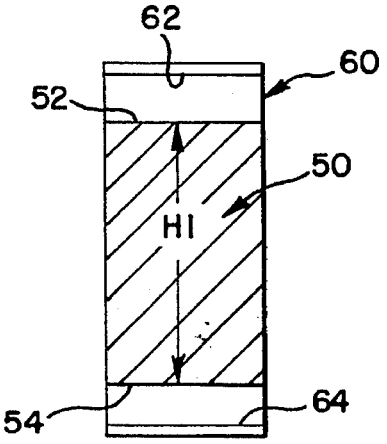
FIG. 7 is a schematic representation of a shoe 50 within a receptacle 60.
Figure 7A:
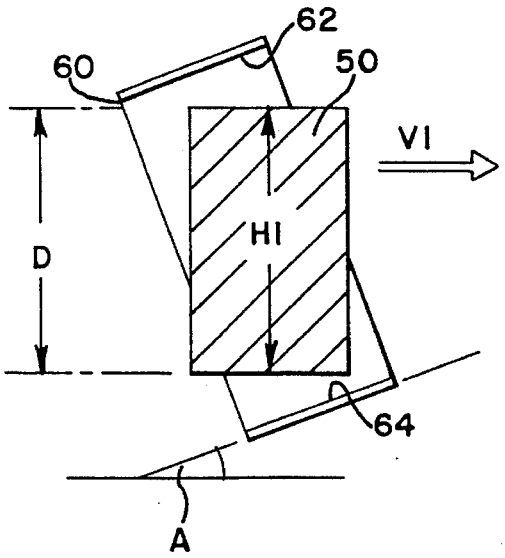
FIG. 7A is a schematic view of the configuration of FIG. 7, with the receptacle 60 rotated 20°.

FIG. 7 discloses a cross-section of a shoe 50, having an upper outer surface 52 and an lower outer surface 54. A receptacle 60 is shown schematically having an inner upper surface 62 and an inner lower surface 64. The shoe 50 of FIG. 7 has a height H1 between its upper and lower outer surfaces 52, 54. FIG. 7A discloses the configuration of FIG. 7 in a condition where the receptacle 60 has rotated to an angle A, which is approximately 20° to the horizontal. As can be seen in FIG. 7A, if after rotation, the receptacle continues in translational movement in a direction along arrow V1, then the shoe 50 will clear the upper and lower receptacle surfaces 60, 64 without contact. To accomplish this, the height H1 of the second end portion 50 is limited, such that H1 is less than the shortest vertical distance D between the upper inner surface 62 and the lower inner surface 64.

Figure 8:
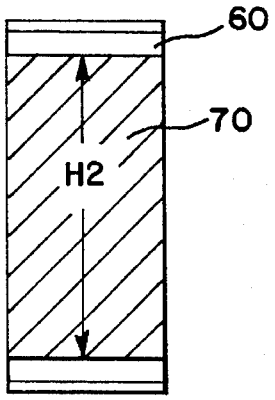
FIG. 8 is a schematic view of the receptacle of FIG. 7 configured with a longer shoe 70.
Figure 8A:
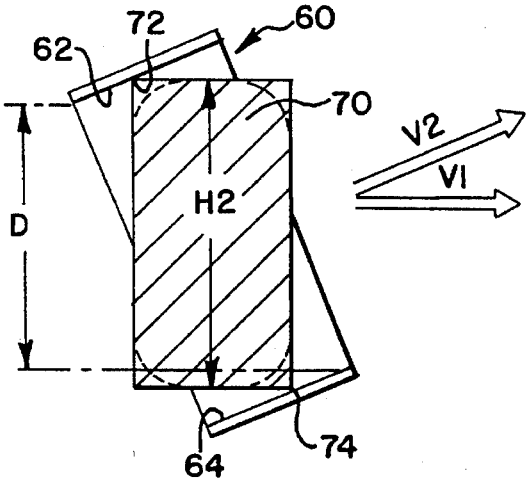
FIG. 8A is a schematic view of the configuration of FIG. 8, with the receptacle 60 rotated 20°.

If a greater height than H1 is desired for a shoe to mate with the dimension of receptacle 60, it can be provided in those instances where an impact, although rotating the receptacle 60, provides a translational movement of the receptacle perpendicular to the rotated position of the receptacle, i.e. in the direction of arrow V2 (FIG. 8A). FIGS. 8 and 8A disclose such a situation. FIG. 8 discloses a second end of a lateral connecting member or shoe 70 having a height H2 which is greater than H1 of the shoe 50. The receptacle 60, however, remains the same as in FIG. 7. As can be seen in FIG. 8, when the receptacle 60 is rotated to the same angle as in FIG. 7A, but is translated in the direction indicated by arrow V2, the outermost corners of upper and lower surfaces 72 and 74 of the shoe 70 clear the upper inner surface 62 and the lower inner surface 64. This embodiment may be desirable in circumstances where it is predetermined that translational movement will occur along a direction, such as indicated by arrow V2. Even in this situation, the greatest distance between any point on the upper outer surface 72 and any point on the lower outer surface 74 must be no greater than the smallest distance between any point on upper inner surface 62 and lower inner surface 64. With the specific rectangular example, this means that a diagonal of shoe 70 cannot be greater than the distance between surfaces 62, 64. It should be noted that if translational movement of the receptacle 60 continues in a direction along arrow V1 of FIG. 8A, serious binding will occur.

Figure 9:
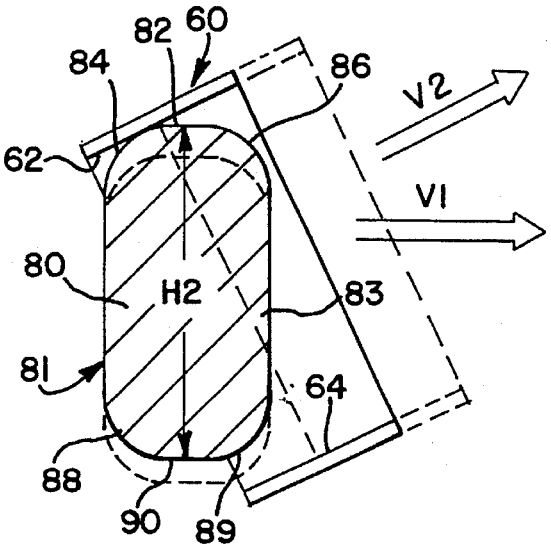
FIG. 9 is a schematic view of the receptacle of FIG. 7 with another shoe 80, according to the invention.

It is believed that most impacts will cause a translational movement along the direction more in accord with arrow V1 of FIG. 8A. Under these conditions, and if a greater shoe height is desired than permitted by the example of FIGS. 7 and 7A, then an alternate example is proposed in FIG. 9 to address this situation. FIG. 9 discloses receptacle 60 with a shoe 80. While the height of shoe 80 is H2, it is believed that it will accommodate translational movement of the receptacle 60 in a direction along either V1 or V2 without binding.

The shoe 80 is of identical height to the shoe 70; however, after rotation of receptacle 60, if the receptacle 60 continues in a translational motion along a direction of arrow V1, its upper surface 62 will collide or engage an arcuate portion 84 of upper surface 82 of the shoe 80. Because the surface 84 is arcuate, minimal interference will take place. In addition, the tension applied to the guide 18 by the tensioning system 20 allows for some vertical play in the shoe 80. Specifically, the tension is applied by strap 21 to an end of guide 18, as shown in FIG. 6. The guide 18 acts as a long lever arm, which results in a rotational force, causing the shoe 22*b* to be urged upward in the direction of arrow B of FIGS. 2 and 6 and slightly inward toward depending portion 34*c* of block 34. An impact sufficient to slidingly separate a shoe from a receptacle involves complex motions and forces. While all of these dynamics are not yet understood, it is believed that, as shown in FIG. 9, in ghost, the shoe 80 may be pushed down against the upward-urging force as a result of surface 84 impacting with upper surface 62 of receptacle 60 as it moves in a direction along arrow V1. Furthermore, it is believed that the impact forces are sufficient that the flexible curtain 12 and the bottom bar 16 may be lifted slightly (also shown in ghost) as the inner upper surface 62 of receptacle 60 rides along the arcuate surface 84 of shoe 80. The downward motion of the shoe 80 or the upward motion of receptacle 60, or a combination of both, permits the successful sliding separation of the receptacle 60 and the shoe 80.

It will be noted, as shown in FIG. 9, again, that, if receptacle 60 is moved translationally along arrow V2, there would be even less contact between the upper surface 82 and the upper inner surface 62. Thus, advantageously, the embodiment shown schematically in FIG. 9 provides acceptable results where the impact force may cause a translational movement of receptacle 60 in any angle of directions between V1 and V2. It will be understood that, if one desires to accommodate a lesser angle, the dimensions, such as H2, may be increased and still obtain acceptable results. It should also be noted that the provision of the arcuate surface 84 reduces the maximum or greatest distance between upper and lower surfaces of shoe 80 because of the reduction of the diagonal extreme. This will permit increasing the height beyond H2, if desired. However, the limitation still applies that the greatest distance between any point on upper surface 82 and any point on lower surface 90 can be no greater than the smallest distance between any point on the upper inner surface 62 and the lower inner surface 64 of receptacle 60.

Thus, it can be seen that for successful separation, it need only be determined what angle of rotation a manufacturer wishes to accommodate, i.e., what the maximum rotation of the bottom bar 16 is desired to be accommodated in a given application and then adjust the relative shapes and dimensions of the shoe and receptacle accordingly.

Figure 10:
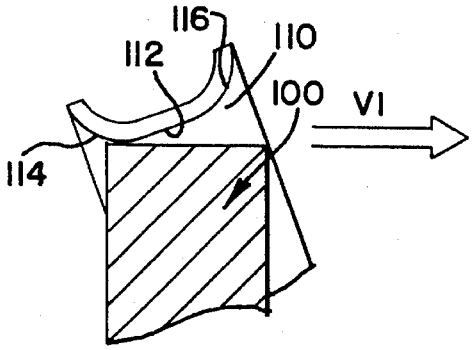
FIG. 10 is a schematic view of a receptacle 110, according to the present invention.
Figure 11:
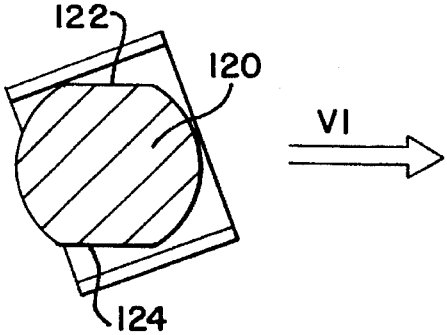
FIG. 11 is a schematic view exemplifying the principals of the invention on an alternate shoe 120; and, FIG. 12 is a cross-sectional view taken along line 12—12 of FIG. 4.

FIG. 10 discloses a shoe 100, according to the principals discussed above, in a separating situation from a receptacle 110. The receptacle 110 and shoe 100 are of the same width dimensions as the embodiments disclosed in FIGS. 7–9 and it is believed that acceptable results may also be provided where, as with receptacle 110, the upper inner surface 112 thereof terminates in arcuate portions 114 and 116. The principles discussed above also apply to shoes of any cross-sectional shape, which present upper outer surfaces and lower outer surfaces and are employed with a receptacle which provides upper and lower inner surfaces. For example, FIG. 11 discloses a shoe 120 having a generally cylindrical cross-section with blunted or flat upper outer surface 122 and flat lower outer surface 124.

Referring now to FIG. 12 and back to FIGS. 3 and 6, it can be seen that the configuration of shoe 22*b* of lateral connecting member 22 and receptacle 24 is similar to the schematic configuration of FIG. 9. It is believed that the shoe 22*b* and receptacle 24 employ the principles discussed with regard to the configuration disclosed in FIG. 9.

Specifically, the shoe 22*b* is of a height and diagonal dimension selected for a range of rotation of receptacle 24, which is expected to be encountered for the configuration. The shoe has opposed sides 47 and 45 of preselected width dimension relative to the receptacle 24. The upper outer surface includes arcuate portions 46*a* and 46*b* connecting it with sides 45 and 47, respectively. The lower outer surface 48 includes arcuate portions 48*a* and 48*b* to connect it with sides 45 and 47, respectively. While not tested, it is believed that shoe 22*b* and receptacle 24 will separate without serious binding, up to 10°–15° of receptacle 24 rotation. While not necessary to practice the invention, a friction plastic seat 43 is interposed between the lower inner surface 42 and the lower outer surface 48 to reduce noise, wear and friction during separation. As disclosed in FIG. 3, such low friction pads are also employed on various side surfaces within the receptacle to reduce noise, wear and friction, both during normal operation and during a separation due to impact.

While the specific embodiments have been illustrated and described, numerous modifications come to mind without significantly departing from the spirit of the invention and the scope of protection is only limited by the scope of the accompanying claims. For example, it is believed the invention will provide the disclosed advantages if the interconnecting member 22 were attached to bottom bar 16 and the receptacle 24 were attached to the guide 18. Also, rather than including arcuate portions in upper or lower surfaces, an inclined or tapered surface would be appropriate

We claim:

1. Apparatus for connecting a movable barrier to a means for guiding the barrier during operation to selectively block an opening, the connection separating upon impact in excess of a predetermined magnitude, comprising:

a lateral connecting member extending laterally and having opposed first and second ends, the first end being attachable to one of either the means for guiding the barrier or the movable barrier and the second end being adapted to be received by a receptacle;

the receptacle being attachable to the other of the means for guiding the barrier or the movable barrier and being adapted to receive the second end of the lateral connecting member; and, the lateral connecting member and the receptacle being cooperatively dimensioned so that, over a predetermined range of accommodatable relative rotation between the receptacle and the lateral connecting member, the rotation being in a plane other than the plane of the barrier, the connecting member and the receptacle are separable upon impact in excess of a predetermined magnitude.

2. The apparatus of claim 1, wherein:

the second end of the lateral connecting member having generally opposed upper and lower outer surfaces;

the receptacle having generally facing, upper and lower inner surfaces; and, the lateral connecting member and the receptacle being cooperatively dimensioned so that, over a predetermined range of relative rotation between the receptacle and the second end of the lateral connecting member, a smallest vertical distance between any point on the upper inner surface and any point on the lower inner surface of the receptacle being no less after rotation than the height between the upper outer surface and the lower outer surface of the second end of the lateral connecting member.

3. The apparatus of claim 1, wherein:

the second end of the lateral connecting member having generally opposed upper and lower outer surfaces;

the receptacle having generally facing, upper and lower inner surfaces; and, the lateral connecting member and the receptacle being cooperatively dimensioned so that, over a predetermined range of relative rotation between the receptacle and the second end of the lateral connecting member, a greatest distance between any point on the upper outer surface and any point on the lower outer surface of the second end of the lateral connecting member being no greater than the smallest distance between any point on the upper inner surface and any point on the lower inner surface of the receptacle.

4. The apparatus of claim 3, wherein the upper and lower inner surfaces of the receptacle terminating in upwardly directed arcuate portions.

5. The apparatus of claim 1, wherein:

the second end of the lateral connecting member having generally opposed upper and lower outer surfaces spaced by side surfaces, the upper and lower outer surfaces including arcuate portions connecting with the side surfaces;

the receptacle having generally facing, upper and lower inner surfaces; and, the lateral connecting member and the receptacle being cooperatively dimensioned so that, over a predetermined range of relative rotation between the receptacle and the second end of the lateral connecting member, a greatest distance between any point on the upper outer surface and any point on the lower outer surface of the second end of the lateral connecting member being no greater than the smallest distance between any point on the upper inner surface and any point on the lower inner surface of the receptacle.

6. The apparatus of claim 5, wherein the second end of the lateral connecting member being an elongate vertical rectangle.

7. The apparatus of claim 5, wherein the second end of the lateral connecting member having a square cross section.

8. The apparatus of claim 5, wherein the second end of the lateral connecting member generally defining a horizontally extending circular cylinder.

9. The apparatus of claim 5, wherein the upper and lower inner surfaces of the receptacle terminating in upwardly directed arcuate portions.

10. The apparatus of claim 1 further comprising means for cooperating with the other of the means for guiding the barrier or the movable barrier to assist in retaining the lateral connecting member in the receptacle, wherein the means for cooperating is on the second end of the lateral connecting member.

11. The apparatus of claim 10 wherein the means for cooperating includes a biased protrusion engaging in a recess.

12. The apparatus of claim 1 further comprising means associated with the lateral connecting member and the receptacle for aligning and releasably holding the lateral connecting member in the receptacle.

13. The apparatus of claim 12 wherein the means for aligning and releasably holding the lateral connecting member in the receptacle includes a slot on the lateral connecting member and a projection within the receptacle that is biased into releasable engagement with the slot.

14. The apparatus of claim 1 wherein the predetermined range of accommodatable relative rotation between the receptacle and the lateral connecting mender is from 0° up to about 90°.

15. The apparatus of claim 1 wherein the predetermined range of accommodatable relative rotation between the receptacle and the lateral connecting member is from 0° up to about 20°.

16. An apparatus connecting a movable barrier to a means for guiding the barrier during operation to selectively block an opening, the connection separating upon impact in excess of a predetermined magnitude, comprising:

a lateral connecting member extending laterally and having opposed first and second ends, the first end being on one of either the means for guiding the barrier or the movable barrier and the second end being adapted to be received by a receptacle;

the receptacle being on the other of the means for guiding the barrier or the movable barrier and being adapted to receive the second end of the lateral connecting member; and, the lateral connecting member and the receptacle being cooperatively dimensioned so that, over a predetermined range of accommodatable relative rotation between the receptacle and the lateral connecting member, the rotation being in a plane other than the plane of the barrier, the connecting member and the receptacle are separable upon an impact in excess of a predetermined magnitude.

17. The apparatus of claim 16 wherein the receptacle comprises:

a first block having first, second and third portions, the first portion being on one of the means for guiding the barrier or the movable barrier, the second portion being adjacent the first portion and extending beyond an end of the other of the means for guiding the barrier or the movable barrier, and the third portion extending from the second portion; and, a second block having first and second portions, the first portion of the second block being on the other of the means for guiding the barrier or the movable barrier, and the second portion of the second block being adjacent the first portion of the second block and extending beyond an end of the other of the means for guiding the barrier or the movable barrier.

18. The apparatus of claim 17 wherein the first block is an upper block, the second block is a lower block positioned below the upper block, and the third portion of the first block depends from the second portion of the first block toward the lower block.

19. The apparatus of claim 16 wherein the second end of the lateral connecting member defines a shoe adjacent the first end of the lateral connecting member, and the receptacle being adapted to receive the shoe.

20. The apparatus of claim 19 wherein the shoe is elongate and has a vertical orientation.

21. The apparatus of claim 20 wherein the shoe extends above the first end of the lateral connecting member.

22. The apparatus of claim 16 wherein the lateral connecting member includes a base portion which extends from the first end of the lateral connecting member and is attached to the one of either the means for guiding the barrier or the movable barrier.

23. The apparatus of claim 16 wherein the predetermined range of accommodatable relative rotation between the receptacle and the lateral connecting member is from 0° up to about 90°.

24. The apparatus of claim 16 wherein the predetermined range of accommodatable relative rotation between the receptacle and the lateral connecting member is from 0° up to about 20°.

* * * * *

UNITED STATES PATENT AND TRADEMARK OFFICE

CERTIFICATE OF CORRECTION

PATENT NO. : 5,620,039

DATED : April 15, 1997

INVENTOR(S) : Joe M. Delgado and Walenty Kalempa

It is certified that error appears in the above-indentified patent and that said Letters Patent is hereby corrected as shown below:

In Column 4, line 59, replace "upper-facing" with --upward-facing--.

In Claim 14, line 64, replace "mender" with --member--.

Signed and Sealed this

Ninth Day of September, 1997

*Attest:*

*Attesting Officer*

BRUCE LEHMAN

*Commissioner of Patents and Trademarks*